US011619902B2

(12) United States Patent
Tezuka et al.

(10) Patent No.: US 11,619,902 B2
(45) Date of Patent: Apr. 4, 2023

(54) CONVEYANCE CONTROL FOR IMAGE FORMING APPARATUS

(71) Applicant: CANON KABUSHIKI KAISHA, Tokyo (JP)

(72) Inventors: Shuntaro Tezuka, Shizuoka (JP); Masanori Yamagata, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/404,043

(22) Filed: Aug. 17, 2021

(65) Prior Publication Data

US 2022/0066375 A1 Mar. 3, 2022

(30) Foreign Application Priority Data

Aug. 25, 2020 (JP) ..... JP2020-141383

(51) Int. Cl.
*G03G 15/00* (2006.01)
*G03G 15/16* (2006.01)

(52) U.S. Cl.
CPC ..... *G03G 15/6529* (2013.01); *G03G 15/1605* (2013.01)

(58) Field of Classification Search
CPC ..... B65H 5/36; B65H 2404/6111; G03G 15/6529; G03G 15/6558; G03G 15/235; G03G 2215/00679; G03G 2215/00409
See application file for complete search history.

(56) References Cited

U.S. PATENT DOCUMENTS

2001/0033760 A1* 10/2001 Sawanaka ..... G03G 15/6594 399/388
2012/0242029 A1* 9/2012 Nada ..... B41J 13/103 271/3.2
2016/0060058 A1* 3/2016 Sugiyama ..... B65H 5/062 271/225
2017/0176913 A1* 6/2017 Oya ..... B65H 85/00
2018/0170701 A1* 6/2018 Mizuguchi ..... B65H 9/004
2019/0354057 A1* 11/2019 Okamoto ..... G03G 15/657

FOREIGN PATENT DOCUMENTS

JP 2017078788 A 4/2017

* cited by examiner

*Primary Examiner* — Jessica L Eley
(74) *Attorney, Agent, or Firm* — Rossi, Kimms & McDowell LLP

(57) ABSTRACT

An image forming apparatus includes an image bearing member, a developing portion, a transfer member, a conveyance portion, a guide member disposed on the same side as the image bearing member with respect to a conveyance path, the guide member being configured to guide the sheet conveyed by the conveyance portion toward the transfer portion, a rotary member disposed to oppose the guide member and configured to be movable between a first position and a second position, and an urging portion. An urging force of the urging portion is set such that the rotary member is positioned at the first position in a case where a first sheet having a first stiffness is conveyed, and such that the rotary member is positioned at the second position by being pushed by a second sheet having a second stiffness.

16 Claims, 5 Drawing Sheets

CONVEYANCE CONTROL FOR IMAGE FORMING APPARATUS

BACKGROUND OF THE INVENTION

Field of the Invention

The present invention relates to an image forming apparatus that forms an image on a sheet.

Description of the Related Art

Conventionally, a printer including a transfer roller that transfers a toner image from an image bearing member onto a sheet in a transfer nip and a registration roller pair that conveys the sheet toward the transfer nip is proposed, for example, in Japanese Patent Laid-Open No. 2017-78788. An upper conveyance guide and a lower conveyance guide that guide the sheet are provided between the registration roller pair and the transfer nip, and a guide roller and an auxiliary guide portion are provided on the upper conveyance guide. The leading end portion of the sheet having passed through the registration roller pair is conveyed along the guide roller, and the trailing end of the sheet is conveyed along the auxiliary guide portion after passing guide roller.

Incidentally, particularly in a printer having a high sheet conveyance speed and a high image formation speed, the image to be transferred onto the sheet might be disturbed in the case where the sheet flutters or vibrates before the transfer nip.

In the printer disclosed in Japanese Patent Laid-Open No. 2017-78788, since the guide roller and the auxiliary guide portion are provided at an upstream end portion of the upper conveyance guide in the sheet conveyance direction, the guide roller and the auxiliary guide portion are away from the transfer nip. Therefore, the behavior of the sheet in the vicinity of the transfer nip cannot be controlled, which causes the sheet to flutter and thus causes an image defect. In addition, there is also a problem that if the force to hold the sheet is increased to suppress the fluttering of the sheet, the conveyance resistance increases and a conveyance failure occurs, and appropriate values for the sheet holding force and conveyance resistance differ depending on the stiffness of the sheet.

SUMMARY OF THE INVENTION

According to one aspect of the present invention, an image forming apparatus includes an image bearing member configured to bear an electrostatic latent image, a developing portion configured to develop the electrostatic latent image borne on the image bearing member as a toner image, a transfer member configured to form a transfer portion between the transfer member and the image bearing member and transfer the toner image borne on the image bearing member onto a sheet in the transfer portion, a conveyance portion configured to convey the sheet toward the transfer portion, a guide member disposed on the same side as the image bearing member with respect to a conveyance path that is provided between the conveyance portion and the transfer portion and that the sheet passes through, the guide member being configured to guide the sheet conveyed by the conveyance portion toward the transfer portion, a rotary member disposed to oppose the guide member and configured to be movable between a first position and a second position and rotate in accordance with the sheet conveyed by the conveyance portion, the first position being a position where the rotary member projects into the conveyance path, the second position being a position where the rotary member is farther away from the guide member than at the first position, and an urging portion configured to urge the rotary member toward the first position, wherein an urging force of the urging portion is set such that the rotary member is positioned at the first position in a case where a first sheet having a first stiffness is conveyed by the conveyance portion and the transfer portion simultaneously, and such that the rotary member is positioned at the second position by being pushed by a second sheet having a second stiffness higher than the first stiffness in a case where the second sheet is conveyed by the conveyance portion and the transfer portion simultaneously.

Further features of the present invention will become apparent from the following description of exemplary embodiments with reference to the attached drawings.

DESCRIPTION OF THE EMBODIMENTS

Overall Configuration

A printer 1 serving as an image forming apparatus is a laser beam printer of an electrophotographic system that forms a monochromatic toner image. To be noted, a sheet S described below is a sheet on which an image is formed by the printer 1, and examples thereof include a plurality of kinds of sheets such as plain paper sheets, thin paper sheets, coated paper sheets, cardboards, and overhead transparency sheets.

Figure 1:
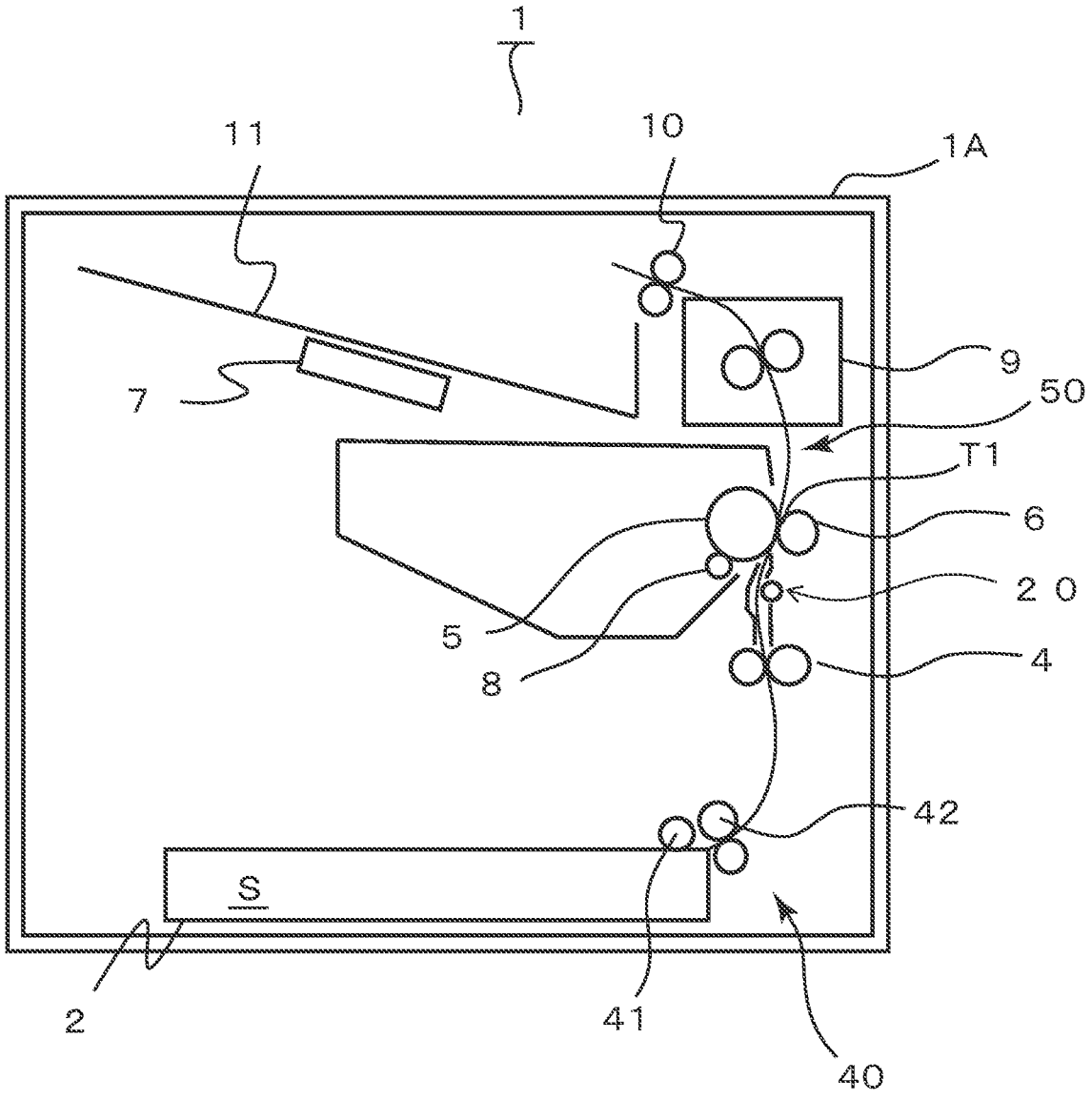
FIG. 1 is an overall schematic view of a printer according to an embodiment.

As illustrated in FIG. 1, the printer 1 includes a sheet feeding portion 40 that feeds a sheet, and an image forming portion 50 that conveys the sheet fed by the sheet feeding portion 40 and forms an image on the sheet. In addition, the printer 1 includes a fixing unit 9 that fixes an image transferred onto the sheet to the sheet, and a discharge roller pair 10 capable of discharging the sheet onto a discharge tray 11.

When an image formation job is output to the printer 1, an image formation process by the image forming portion 50 is started on the basis of image information input from an external computer or the like connected to the printer 1. The image forming portion 50 includes a pre-transfer guide mechanism 20 that will be described later, a laser scanner 7, a photosensitive drum 5, a charging roller 5*a* illustrated in FIG. 2, a developing roller 8, and a transfer roller 6. The photosensitive drum 5, the charging roller 5*a*, and the developing roller 8 are integrated as a cartridge so as to be easily replaceable. The photosensitive drum 5 and the transfer roller 6 form a transfer nip T1 serving as a transfer portion.

The laser scanner 7 emits laser light toward the photosensitive drum 5 on the basis of the input image information. At this time, the photosensitive drum 5 serving as an image bearing member is charged in advance by the charging roller 5*a*, and an electrostatic latent image is formed on the photosensitive drum 5 by being irradiated with the laser light. Then, this electrostatic latent image is developed by the developing roller 8 serving as a developing portion, and thus a monochromatic toner image is formed on the photosensitive drum 5.

In parallel with the image formation process described above, a sheet S is fed from the sheet feeding portion 40. The sheet feeding portion 40 includes a cassette 2 that can be attached to and drawn out from an apparatus body 1A of the printer 1, a feed roller 41, and a separation roller pair 42. Sheets S accommodated in the cassette 2 are fed by the feed roller 41, and in the case where a plurality of sheets S are fed by the feed roller 41, one sheet S is separated from the plurality of sheets S by the separation roller pair 42.

To be noted, an inner plate capable of supporting sheets and capable of ascending and descending may be provided in the cassette 2, and for example, the inner plate may be lifted up in response to input of an image formation job so as to bring a sheet supported on the inner plate into contact with the feed roller 41. In addition, one of the separation roller pair 42 may be a pad or the like, and a torque limiter system, a retard roller system, or the like may be employed for the separation roller pair 42.

The sheet S separated from the sheets S by the separation roller pair 42 is conveyed by a conveyance roller pair 4 serving as a conveyance portion. To be noted, the conveyance roller pair 4 may be constituted by a registration roller pair capable of correcting the skew of the sheet S. The skew of the sheet S is corrected when the sheet S abuts a nip between the registration roller pair that is not operating. The registration roller pair conveys the sheet S at a timing matching a transfer timing of a toner image in the transfer nip T1.

The sheet S conveyed by the conveyance roller pair 4 is guided to the transfer nip T1 by the pre-transfer guide mechanism 20. The toner image on the photosensitive drum 5 is transferred onto the sheet S in the transfer nip T1 as a result of an electrostatic load bias applied to the transfer roller 6 serving as a transfer member. Residual toner remaining on the photosensitive drum 5 is collected by an unillustrated cleaning blade. The sheet S onto which the toner image has been transferred is subjected to predetermined heat and pressure in the fixing unit 9, and thus the toner is melted and fixed to the sheet S. The sheet S having passed through the fixing unit 9 is discharged onto the discharge tray 11 by the discharge roller pair 10.

Pre-Transfer Guide Mechanism

Figure 2:
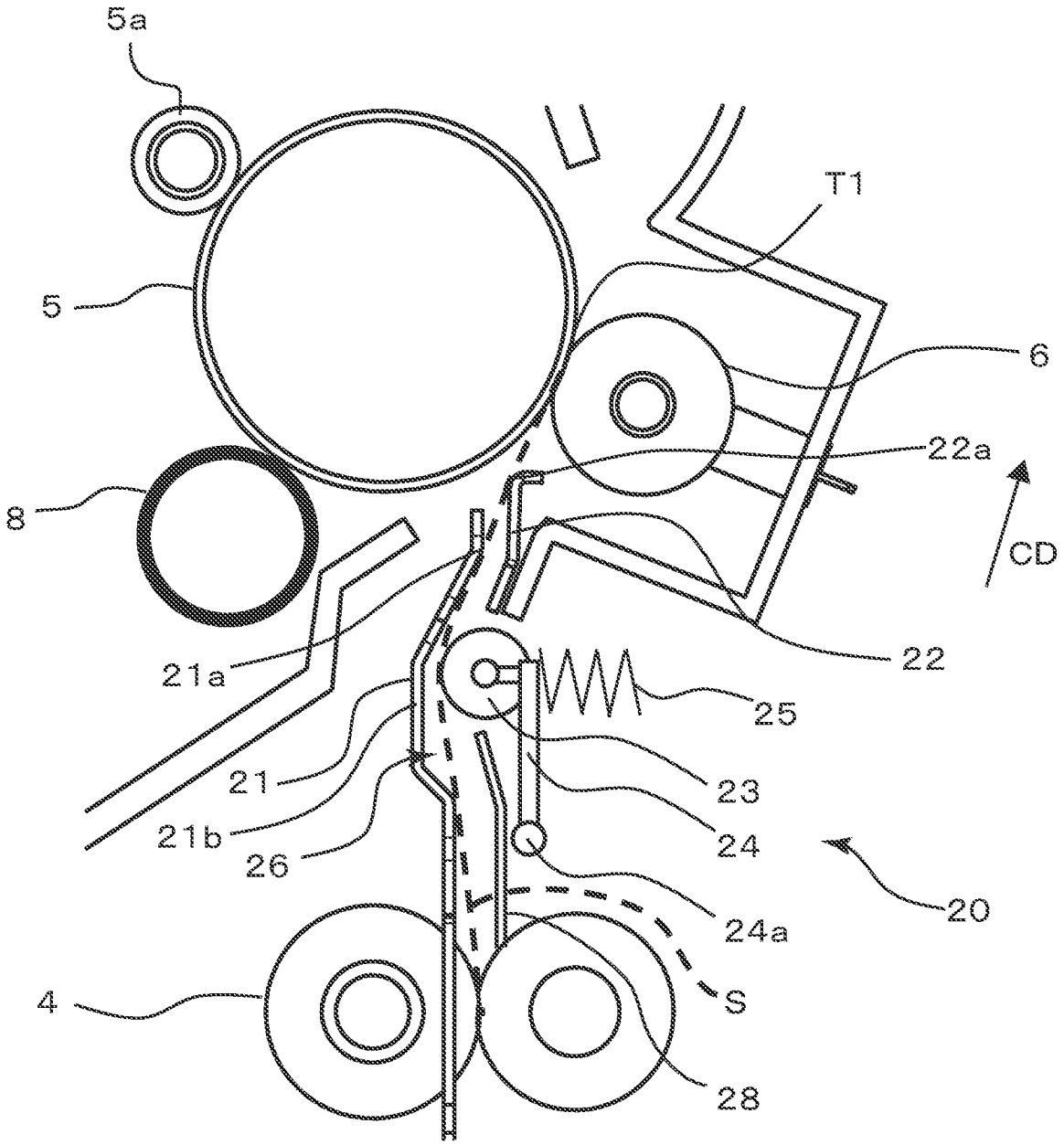
FIG. 2 is a section view of a pre-transfer guide mechanism.

Next, a configuration of the pre-transfer guide mechanism 20 will be described with reference to FIGS. 2 and 3. As illustrated in FIG. 2, the pre-transfer guide mechanism 20 includes a first guide member 21, a second guide member 22, a third guide member 28, roller members 23, a support member 24, and a pressurizing spring 25.

The second guide member 22 and the third guide member 28 are disposed to oppose the first guide member 21 serving as a guide member, and the first guide member 21, the second guide member 22, and the third guide member 28 define a conveyance path 26. The sheet S passes through the conveyance path 26 between the conveyance roller pair 4 and the transfer nip T1.

The first guide member 21 is disposed on the same side as the photosensitive drum 5 with respect to the conveyance path 26, and the second guide member 22, the third guide member 28, the roller members 23, the support member 24, and the pressurizing spring 25 are disposed on the same side as the transfer roller 6 with respect to the conveyance path 26. The roller members 23 serving as rotary members are disposed in the vicinity of a joining portion between the second guide member 22 and the third guide member 28 in a sheet conveyance direction CD so as to oppose the first guide member 21. The roller members 23 rotate in accordance with the sheet S conveyed by the conveyance roller pair 4. The first guide member 21 has a curved portion 21*b* curved in a direction away from the roller members 23, and the second guide member 22 guides the sheet S in a direction oriented a little more toward the photosensitive drum 5 than directly toward the transfer nip T1.

Therefore, the conveyance path 26 is loosely formed in an S shape, and the sheet S indicated by a broken line in FIG. 2 enters the transfer nip T1 at an angle following the photosensitive drum 5. Therefore, the impact that the sheet S receives when coming into contact with the photosensitive drum 5 is reduced, and a damage to the photosensitive drum 5 caused by the leading end of the sheet S can be also reduced. In addition, scattering of toner occurring when the toner is transferred from the photosensitive drum 5 onto the sheet S can be reduced.

A contact portion 21*a* capable of coming into contact with the sheet S is provided at a downstream end portion of the first guide member 21 in the sheet conveyance direction CD, and a contact portion 22*a* capable of coming into contact with the sheet S is provided at a downstream end portion of the second guide member 22 in the sheet conveyance direction CD. The contact portion 21*a* serving as a first contact portion is positioned downstream of the roller members 23 in the sheet conveyance direction CD, and the contact portion 22*a* serving as a second contact portion is disposed between the contact portion 21*a* and the transfer nip T1 in the sheet conveyance direction CD.

The support member 24 is supported so as to be pivotable about a pivot shaft 24*a*, and the roller members 23 are rotatably supported at a distal end portion of the support member 24. The pivot shaft 24*a* is disposed upstream of the roller members 23 in the sheet conveyance direction CD. The roller members 23 are provided to be movable between a first position illustrated in FIGS. 2 and 4 and a second position illustrated in FIG. 5 by the pivot of the support member 24. The roller members 23 project into the conveyance path 26 at the first position, and is farther from the first guide member 21 at the second position than at the first position.

Figure 4:
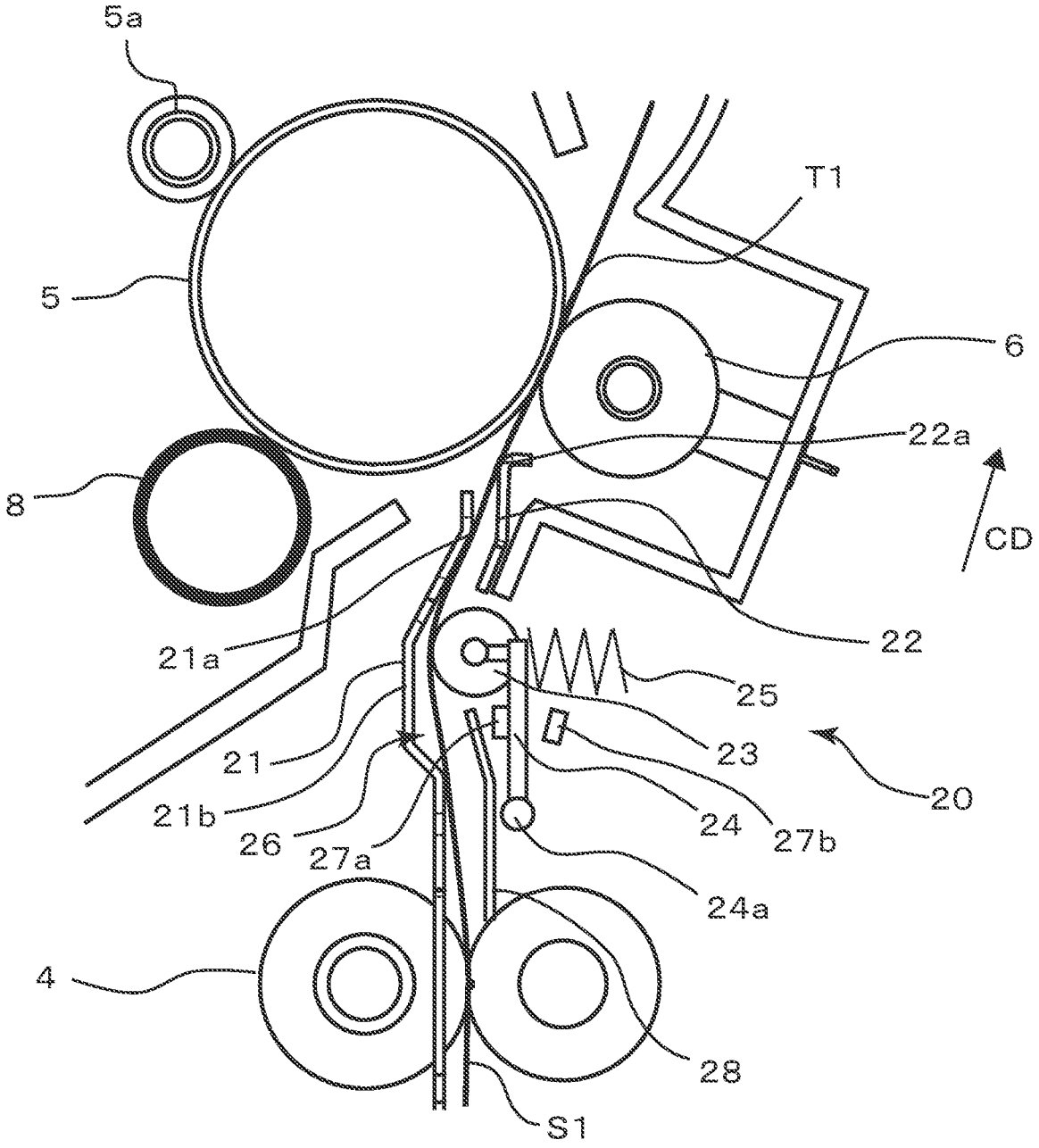
FIG. 4 is a section view of the pre-transfer guide mechanism illustrating how the roller members operate when a first sheet having a first stiffness is conveyed.

The roller members 23 are urged toward the first position as a result of the support member 24 being urged by the pressurizing spring 25, and the pivot range of the support member 24 is restricted by a first restricting member 27*a* and a second restricting member 27*b* as illustrated in FIG. 4. When the roller members 23 are at the first position, the support member 24 is in contact with the first restricting member 27*a*, and when the roller members 23 are at the second position, the support member 24 is in contact with the second restricting member 27*b*. The pressurizing spring 25 serving as an urging portion is constituted by a compression coil spring serving as a coil spring.

Figure 3:
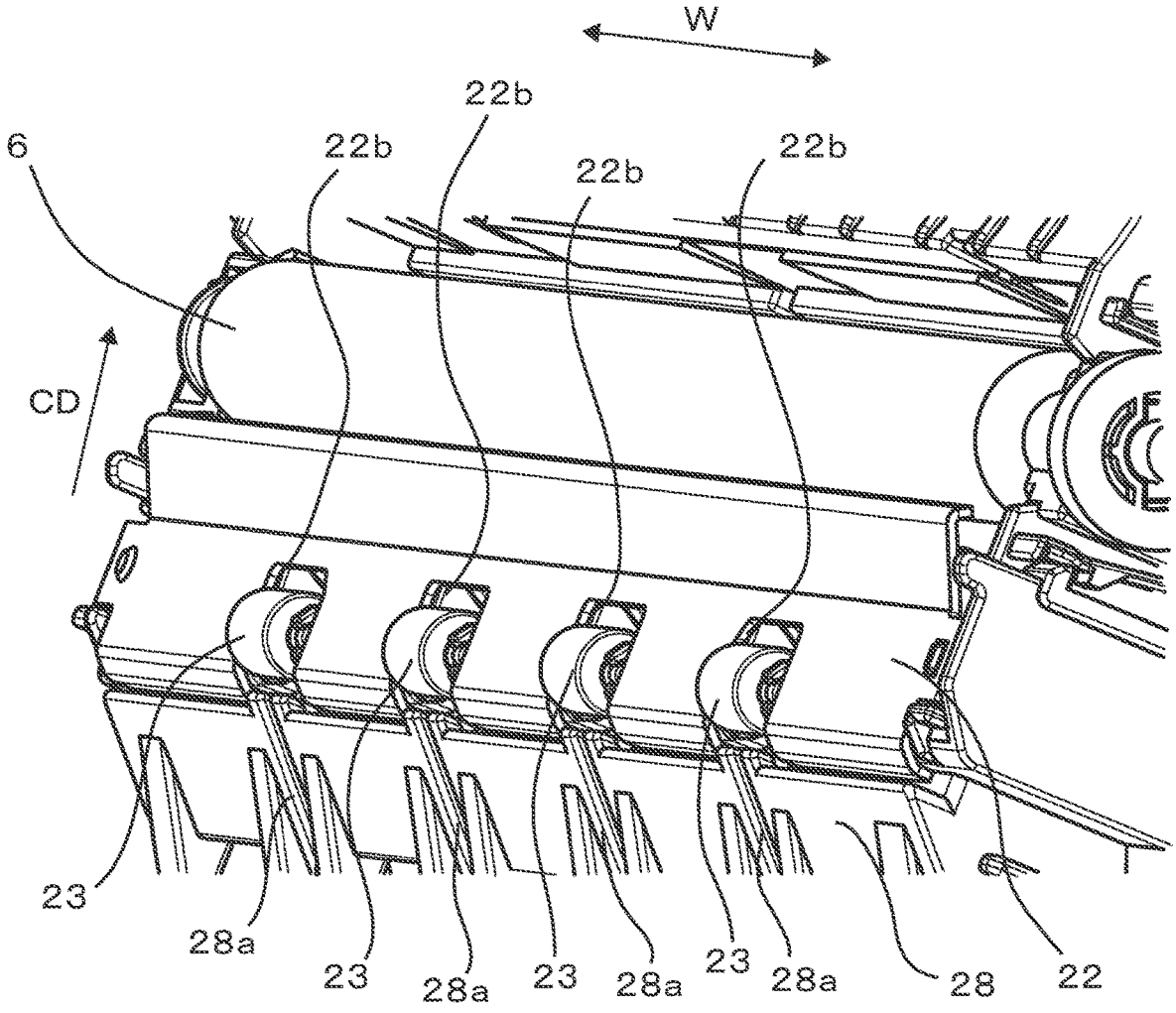
FIG. 3 is a perspective view of roller members.

As illustrated in FIG. 3, the roller members 23 are arranged in parallel in a width direction W perpendicular to the sheet conveyance direction CD. The third guide member 28 includes a plurality of ribs 28*a* for guiding the sheet S toward the plurality of roller members 23. The second guide member 22 has a plurality of opening portions 22*b* through which the plurality of roller members 23 project into the conveyance path 26. To be noted, the plurality of roller members 23 may be supported by one support member 24, or may be supported by the same number of support members 24 as the roller members 23.

Operation of Roller Members

Figure 5:
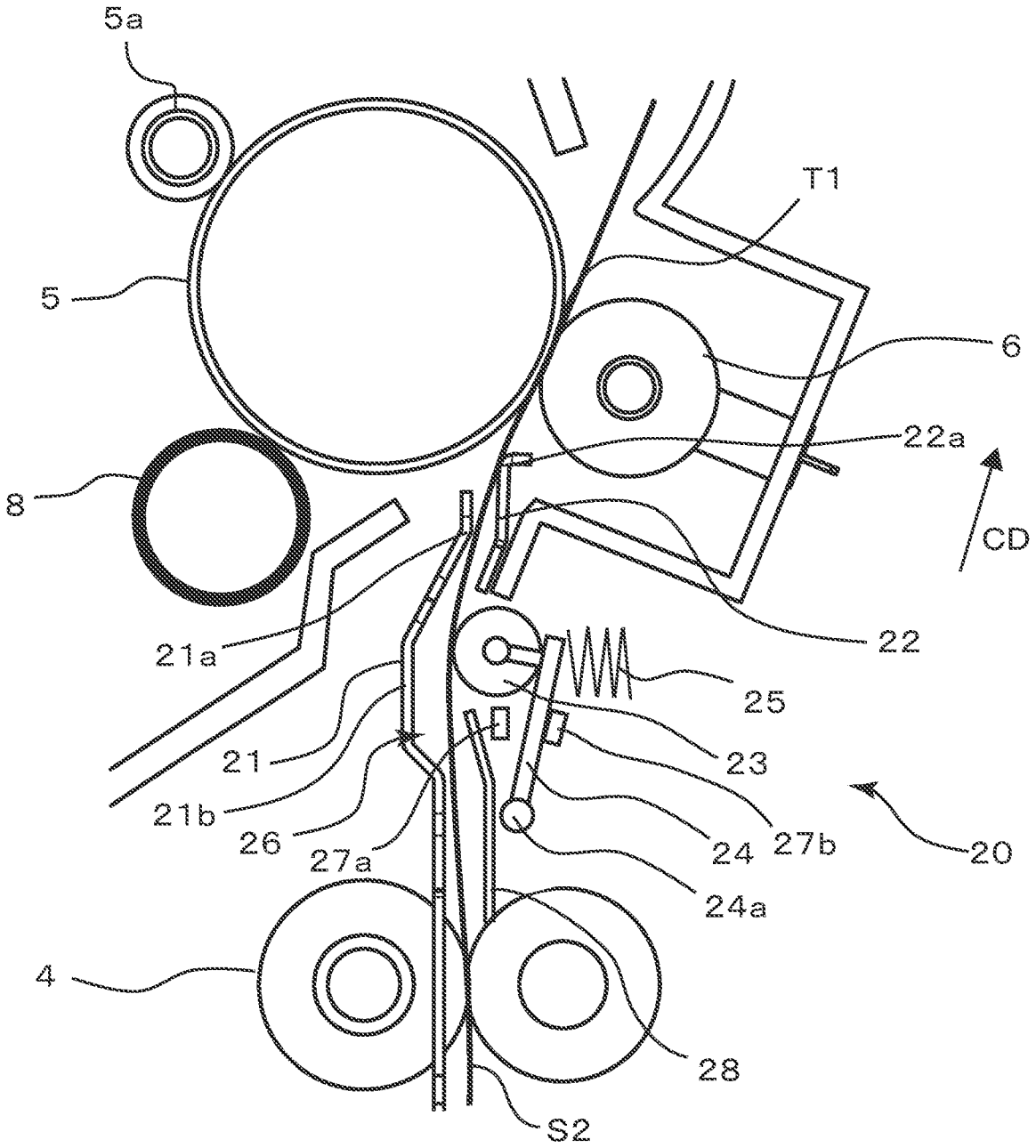
FIG. 5 is a section view of the pre-transfer guide mechanism illustrating how the roller members operate when a second sheet having a second stiffness is conveyed.

Next, the operation of the roller members 23 for cases where two sheets having different stiffness are conveyed will be described. FIG. 4 is a section view of the pre-transfer guide mechanism 20 illustrating how the roller members 23 operate when a first sheet S1 having a first stiffness is conveyed. FIG. 5 is a section view of the pre-transfer guide mechanism 20 illustrating how the roller members 23 operate when a second sheet S2 having a second stiffness higher than the first stiffness is conveyed.

Examples of the first sheet S1 include thin paper sheets and plain paper sheets. For example, a thin paper sheet has a grammage of 52 to 63 g/m$^2$, and a plain paper sheet has a grammage of 64 to 105 g/m$^2$. That is, the first sheet S1 has a first grammage. Examples of the second sheet S2 include cardboards and coated paper sheets. For example, a cardboard has a grammage of 106 to 300 g/m$^2$. That is, the second sheet S2 has a second grammage larger than the first grammage.

As illustrated in FIG. 4, the first sheet S1 is conveyed by the conveyance roller pair 4, and is guided to the transfer nip T1 through the conveyance path 26. In this case, the roller members 23 are in contact with the first sheet S1 being conveyed and nipped by both the conveyance roller pair 4 and transfer nip T1 simultaneously, and are pressed by the reaction force from the first sheet S1 that is curved along the first guide member 21. The reaction force corresponds to the stiffness of the first sheet S1. However, since the first sheet S1 has a relatively low stiffness, the reaction force from the first sheet S1 described above is smaller than the urging force of the pressurizing spring 25.

Therefore, the first sheet S1 cannot push the roller members 23 from the first position to the second position against the urging force of the pressurizing spring 25, and thus the roller members 23 are positioned at the first position. The roller members 23 positioned at the first position guide the first sheet S1 such that the first sheet S1 is into contact with the contact portion 21*a* of the first guide member 21. In addition, the first sheet S1 is also in contact with the contact portion 22*a* of the second guide member 22.

That is, the first sheet S1 is nipped in the thickness direction thereof between the roller members 23 positioned at the first position and the contact portions 21*a* and 22*a*, and thus the orientation of the first sheet S1 is regulated. As a result of this, the fluttering and vibration of the first sheet S1 are suppressed, thus the sheet can be conveyed stably, and occurrence of an image defect can be suppressed. In addition, since the first sheet S1 has a relatively low stiffness, the conveyance resistance does not become excessively high even when restricted by the roller members 23 positioned at the first position and the contact portions 21*a* and 22*a*, and thus the occurrence of a conveyance failure is suppressed.

In contrast, as illustrated in FIG. 5, the second sheet S2 having a higher stiffness than the first sheet S1 is conveyed by the conveyance roller pair 4, and is guided to the transfer nip T1 through the conveyance path 26. At this time, the roller members 23 are in contact with the second sheet S2 that is nipped and conveyed by both the conveyance roller pair 4 and the transfer nip T1 simultaneously, and are pressed by the reaction force of the second sheet S2 curved along the first guide member 21. The reaction force corresponds to the stiffness of the second sheet S2. Since the second sheet S2 has a relatively high stiffness, the reaction force of the second sheet S2 is larger than the urging force of the pressurizing spring 25.

Therefore, the second sheet S2 pushes the roller members 23 from the first position to the second position against the urging force of the pressurizing spring 25, and the roller members 23 is positioned at the second position as a result of the support member 24 abutting the second restricting member 27*b*. Incidentally, the roller members 23 swing from the first position to the second position about the pivot shaft 24*a* positioned upstream of the roller members 23 in the sheet conveyance direction CD. Therefore, the direction in which the roller members 23 are rotated by a force applied from the second sheet S2 matches the direction in which the roller members 23 swing about the pivot shaft 24*a*, and thus the roller members 23 can be smoothly moved to the second position.

The second sheet S2 nipped and conveyed by both the conveyance roller pair 4 and the transfer nip T1 simultaneously is in contact with the roller members 23 positioned at the second position and the contact portion 22*a* of the second guide member 22 but is not in contact with the contact portion 21*a* of the first guide member 21.

That is, unlike the first sheet S1, the second sheet S2 is not nipped in the thickness direction thereof between the roller members 23 and the contact portions 21*a* and 22*a*. Since generally the second sheet S2 having a relatively high stiffness is less likely to flutter than the first sheet S1, the occurrence of an image defect is suppressed even if the orientation thereof during conveyance is not regulated by the roller members 23 and the contact portions 21*a* and 22*a*.

In addition, since the second sheet S2 pushes the roller members 23 to the second position by the reaction force thereof, the curve of the second sheet S2 is reduced, and the second sheet S2 does not rub the contact portion 21*a* of the first guide member 21. Therefore, the conveyance resistance of the conveyance of the second sheet S2 can be reduced, and thus the occurrence of a conveyance failure derived from increase in the conveyance resistance can be suppressed. In addition, since the roller members 23 rotate in accordance with the first sheet S1 and the second sheet S2, the conveyance resistance of the sheet can be further reduced as compared with the case where the sheet slides on a fixed member such as a guide.

As described above, in the present embodiment, the urging force of the pressurizing spring 25 is set such that the position of the roller members 23 changes in accordance with the stiffness of the sheet S. Specifically, the roller members 23 are positioned at the first position when the first sheet S1 having a first stiffness is conveyed, and the roller members 23 are positioned at the second position by the reaction force of the second sheet S2 when the second sheet S2 having a second stiffness higher than first stiffness is conveyed.

By setting the urging force of the pressurizing spring 25 as described above, the fluttering of the sheet and the conveyance failure can be suppressed regardless of the stiffness of the sheet, and thus the image defect and conveyance failure can be suppressed. In addition, since the pivot shaft 24*a* of the support member 24 is disposed upstream of the roller members 23 in the sheet conveyance direction CD, the roller members 23 can be smoothly moved to the second position when the roller members 23 are pushed by the second sheet S2.

Other Embodiments

Although the second position of the roller members 23 is restricted by the support member 24 abutting the second restricting member 27*b* in the embodiment described above, the configuration is not limited to this. For example, the second restricting member 27*b* may be omitted.

In addition, although the roller members 23 are positioned at the second position where the support member 24 abuts the second restricting member 27*b* when the second sheet S2 is conveyed, the configuration is not limited to this. For example, when the second sheet S2 is conveyed, the support member 24 may be positioned at a position where the support member 24 is in contact with neither of the first restricting member 27*a* and the second restricting member 27*b*. That is, it suffices as long as the urging force of the pressurizing spring 25 is set such that the roller members 23 are not moved from the first position by the reaction force of the first sheet S1 and are moved from the first position by the reaction force of the second sheet S2.

In addition, although the second sheet S2 nipped and conveyed by both the conveyance roller pair 4 and the transfer nip T1 simultaneously is not in contact with the contact portion 21*a* of the first guide member 21 in the embodiment described above, the configuration is not limited to this. For example, the second sheet S2 may come into contact with the contact portion 21*a* if the second sheet S2 is not strongly bound by the roller members 23 and the contact portions 21*a* and 22*a*.

In addition, although the pivot shaft 24*a* of the support member 24 is disposed upstream of the roller members 23 in the sheet conveyance direction CD in the embodiment described above, the pivot shaft 24*a* may be disposed downstream of the roller members 23.

In addition, although the roller members 23 are constituted by cylindrical rollers in the embodiment described above, the configuration is not limited to this. For example, the roller members 23 may be constituted by balls or belts.

In addition, although a compression coil spring is used as the pressurizing spring 25 in the embodiment described above, the configuration is not limited to this. For example, a different elastic member such as a torsion coil spring or a leaf spring may be used as the pressurizing spring 25.

In addition, although the transfer nip T1 is formed by the photosensitive drum 5 and the transfer roller 6 in the embodiment described above, the configuration is not limited to this. For example, a corona charger may be used in place of the transfer roller 6. In this case, the transfer nip T1 is not formed, and a portion where the toner image is transferred from the photosensitive drum 5 onto the sheet by the corona charger serves as the transfer portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-141383, filed Aug. 25, 2020, which is hereby incorporated by reference herein in its entirety.

What is claimed is:

1. An image forming apparatus comprising:

an image bearing member configured to bear an electrostatic latent image;

a developing portion configured to develop the electrostatic latent image borne on the image bearing member as a toner image;

a transfer member configured to form a transfer portion between the transfer member and the image bearing member and transfer the toner image borne on the image bearing member onto a first surface of a sheet in the transfer portion;

a conveyance portion configured to convey the sheet toward the transfer portion;

a guide member disposed on the same side as the image bearing member with respect to a conveyance path that is provided between the conveyance portion and the transfer portion and that the sheet passes through, the guide member being configured to guide the sheet conveyed by the conveyance portion toward the transfer portion while coming into contact with the first surface of the sheet;

a rotary member disposed to oppose the guide member and configured to be movable between a first position and a second position and rotate in accordance with the sheet conveyed by the conveyance portion, the first position being a position where the rotary member projects into the conveyance path, the second position being a position where the rotary member is farther away from the guide member than at the first position, the rotary member coming into contact with a second surface, which is an opposite side of the first surface, of the sheet in a case where the sheet is conveyed by the conveyance portion and the transfer portion simultaneously; and an urging portion configured to urge the rotary member toward the first position, wherein an urging force of the urging portion is set such that the rotary member is positioned at the first position in a case where a first sheet having a first stiffness is conveyed by the conveyance portion and the transfer portion simultaneously, and such that the rotary member is positioned at the second position by being pushed by a second sheet having a second stiffness higher than the first stiffness in a case where the second sheet is conveyed by the conveyance portion and the transfer portion simultaneously.

2. The image forming apparatus according to claim 1, wherein the guide member comprises a contact portion positioned downstream of the rotary member in a sheet conveyance direction and configured to come into contact with a sheet, and wherein, in the first position, the rotary member is configured to guide the first sheet such that the first sheet comes into contact with the contact portion.

3. The image forming apparatus according to claim 2, wherein the guide member is a first guide member and the contact portion is a first contact portion, wherein the image forming apparatus further comprises a second guide member disposed on the same side as the rotary member with respect to the conveyance path so as to oppose the first guide member, wherein the second guide member comprises a second contact portion disposed between the first contact portion and the transfer portion in the sheet conveyance direction and configured to come into contact with a sheet, and wherein an orientation of the first sheet while being conveyed is regulated by the rotary member positioned at the first position, the first contact portion, and the second contact portion.

4. The image forming apparatus according to claim 3, wherein while the second sheet is conveyed by the conveyance portion and the transfer portion simultaneously, the second sheet is in contact with the rotary member positioned at the second position and the second contact portion and is not in contact with the first contact portion.

5. The image forming apparatus according to claim 1, further comprising a support member supported so as to be pivotable about a pivot shaft and configured to rotatably support the rotary member, wherein the pivot shaft is disposed upstream of the rotary member in a sheet conveyance direction.

6. The image forming apparatus according to claim 5, further comprising:

a first restricting member configured to abut the support member in a case where the rotary member is positioned at the first position; and a second restricting member configured to abut the support member in a case where the rotary member is positioned at the second position.

7. The image forming apparatus according to claim 1, wherein the first sheet has a first grammage, and wherein the second sheet has a second grammage larger than the first grammage.

8. The image forming apparatus according to claim 7, wherein the first grammage is in a range of 52 to 105 g/m$^2$, and wherein the second grammage is in a range of 106 to 300 g/m$^2$.

9. The image forming apparatus according to claim 1, wherein the urging portion is a coil spring.

10. An image forming apparatus comprising:

an image bearing member configured to bear an electrostatic latent image;

a developing portion configured to develop the electrostatic latent image borne on the image bearing member as a toner image;

a transfer member configured to form a transfer portion between the transfer member and the image bearing member and transfer the toner image borne on the image bearing member onto a sheet in the transfer portion;

a conveyance portion configured to convey the sheet toward the transfer portion;

a guide member disposed on the same side as the image bearing member with respect to a conveyance path that is provided between the conveyance portion and the transfer portion and that the sheet passes through, the guide member being configured to guide the sheet conveyed by the conveyance portion toward the transfer portion;

a rotary member disposed to oppose the guide member and configured to be movable between a first position and a second position and rotate in accordance with the sheet conveyed by the conveyance portion, the first position being a position where the rotary member projects into the conveyance path, the second position being a position where the rotary member is farther away from the guide member than at the first position;

a support member supported so as to be pivotable about a pivot shaft and configured to rotatably support the rotary member;

a first restricting member configured to abut the support member in a case where the rotary member is positioned at the first position;

a second restricting member configured to abut the support member in a case where the rotary member is positioned at the second position; and an urging portion configured to urge the rotary member toward the first position, wherein the pivot shaft is disposed upstream of the rotary member in a sheet conveyance direction, and wherein an urging force of the urging portion is set such that the rotary member is positioned at the first position in a case where a first sheet having a first stiffness is conveyed by the conveyance portion and the transfer portion simultaneously, and such that the rotary member is positioned at the second position by being pushed by a second sheet having a second stiffness higher than the first stiffness in a case where the second sheet is conveyed by the conveyance portion and the transfer portion simultaneously.

11. The image forming apparatus according to claim 10, wherein the guide member comprises a contact portion positioned downstream of the rotary member in a sheet conveyance direction and configured to come into contact with a sheet, and wherein, in the first position, the rotary member is configured to guide the first sheet such that the first sheet comes into contact with the contact portion.

12. The image forming apparatus according to claim 11, wherein the guide member is a first guide member and the contact portion is a first contact portion, wherein the image forming apparatus further comprises a second guide member disposed on the same side as the rotary member with respect to the conveyance path so as to oppose the first guide member, wherein the second guide member comprises a second contact portion disposed between the first contact portion and the transfer portion in the sheet conveyance direction and configured to come into contact with a sheet, and wherein an orientation of the first sheet while being conveyed is regulated by the rotary member positioned at the first position, the first contact portion, and the second contact portion.

13. The image forming apparatus according to claim 12, wherein while the second sheet is conveyed by the conveyance portion and the transfer portion simultaneously, the second sheet is in contact with the rotary member positioned at the second position and the second contact portion and is not in contact with the first contact portion.

14. The image forming apparatus according to claim 10, wherein the first sheet has a first grammage, and wherein the second sheet has a second grammage larger than the first grammage.

15. The image forming apparatus according to claim 14, wherein the first grammage is in a range of 52 to 105 g/m$^2$, and wherein the second grammage is in a range of 106 to 300 g/m$^2$.

16. The image forming apparatus according to claim 10, wherein the urging portion is a coil spring.

* * * * *